US011633960B2

(12) United States Patent
Tanimoto

(10) Patent No.: US 11,633,960 B2
(45) Date of Patent: Apr. 25, 2023

(54) PRINT HEAD AND IMAGE FORMING APPARATUS

(71) Applicants: TOSHIBA TEC KABUSHIKI KAISHA, Tokyo (JP); FUTABA CORPORATION, Chiba (JP)

(72) Inventor: Koji Tanimoto, Tagata Shizuoka (JP)

(73) Assignees: Toshiba Tec Kabushiki Kaisha, Tokyo (JP); FUTABA CORPORATION, Chiba (JP)

( * ) Notice: Subject to any disclaimer, the term of this patent is extended or adjusted under 35 U.S.C. 154(b) by 0 days.

(21) Appl. No.: 17/384,346

(22) Filed: Jul. 23, 2021

(65) Prior Publication Data

US 2022/0203705 A1 Jun. 30, 2022

(30) Foreign Application Priority Data

Dec. 24, 2020 (JP) ..... JP2020-214476

(51) Int. Cl.
*B41J 2/45* (2006.01)
*B41J 2/47* (2006.01)

(52) U.S. Cl.
CPC .. *B41J 2/47* (2013.01); *B41J 2/45* (2013.01)

(58) Field of Classification Search
CPC ..... B41J 2/45; B41J 2/47
See application file for complete search history.

(56) References Cited

U.S. PATENT DOCUMENTS

2007/0242017 A1 10/2007 Mitsuse et al.
2009/0147278 A1* 6/2009 Tsujino ..... B41J 2/45 358/1.8
2010/0026214 A1* 2/2010 Nagumo ..... G03G 15/04054 315/312
2011/0274465 A1* 11/2011 Ohno ..... B41J 2/45 315/312
2012/0056547 A1 3/2012 Mitsuse et al.

FOREIGN PATENT DOCUMENTS

JP H04-348963 A 12/1992
JP 2000-168127 A 6/2000
JP 2007-283599 A 11/2007
JP 2015-112856 A 6/2015
JP 2016-043518 A 4/2016
JP 2016-173488 A 9/2016

* cited by examiner

*Primary Examiner* — Christopher E Mahoney
*Assistant Examiner* — Kendrick X Liu
(74) *Attorney, Agent, or Firm* — Kim & Stewart LLP

(57) ABSTRACT

According to an embodiment, a print head includes one or more light emitting element arrays, a light emission control circuit, and one or more drive circuit arrays. The light emitting element arrays include a plurality of light emitting elements arrayed continuously along a main scanning direction. The light emission control circuit outputs drive signals of different phases in units of a light emitting element group configured by a predetermined number of continuous light emitting elements included in the light emitting elements. The drive circuit arrays include a plurality of drive circuits, the drive circuits cause the light emitting elements to emit light individually based on the drive signals.

20 Claims, 17 Drawing Sheets

PRINT HEAD AND IMAGE FORMING APPARATUS

CROSS-REFERENCE TO RELATED APPLICATION

This application is based upon and claims the benefit of priority from prior Japanese Patent Application No. 2020-214476, filed Dec. 24, 2020, the entire contents of which are incorporated herein by reference.

FIELD

Embodiments described herein relate generally to a print head and an image forming apparatus.

BACKGROUND

An electrophotographic printer (referred to as a printer hereinafter) with a print head is widely spread. The print head includes a plurality of light emitting elements. As the light emitting elements, there are ones using a light emitting diode (LED) and ones using an organic light emitting diode (OLED). For example, the print head is provided with light emitting elements corresponding to 15400 pixels. The light emitting elements are arrayed in a main scanning direction, and a direction orthogonal to the main scanning direction is a sub-scanning direction. The printer exposes a photoreceptor drum with light emitted from the light emitting elements, and prints an image, which corresponds to a latent image formed on the photoreceptor drum, on a sheet as recording paper.

As described above, the print head is provided with a plurality of light emitting elements. It is known that if the light emitting elements are simultaneously turned on or turned off to print a linear image or the like, an inrush current to a drive circuit (a change in the current) increases. Technologies are thus required to reduce the load of the change in current.

BRIEF DESCRIPTION OF THE DRAWINGS

A general architecture that implements various features of the embodiments will now be described with reference to the drawings. The drawings and their associated descriptions are provided to illustrate the embodiments and not to limit the scope of the invention.

DETAILED DESCRIPTION

According to an embodiment, a print head includes one or more light emitting element arrays, a light emission control circuit, and one or more drive circuit arrays. The light emitting element arrays include a plurality of light emitting elements arrayed continuously along a main scanning direction. The light emission control circuit outputs drive signals of different phases in units of a light emitting element group configured by a predetermined number of continuous light emitting elements included in the light emitting elements. The drive circuit arrays include a plurality of drive circuits, the drive circuits cause the light emitting elements to emit light individually based on the drive signals.

An example of an image forming apparatus according to the embodiment will be described below with reference to the drawings. Like symbols are used throughout the drawings to refer to like components. The image forming apparatus is a printer, a copying machine or a multi-functional peripheral (MFP). The present embodiment is directed to an image forming apparatus corresponding to the MFP.

[Configuration of Print Head)

An example of a configuration of a print head applied to the image forming apparatus according to the embodiment will be described with reference to FIGS. 1 to 10.

Figure 1:
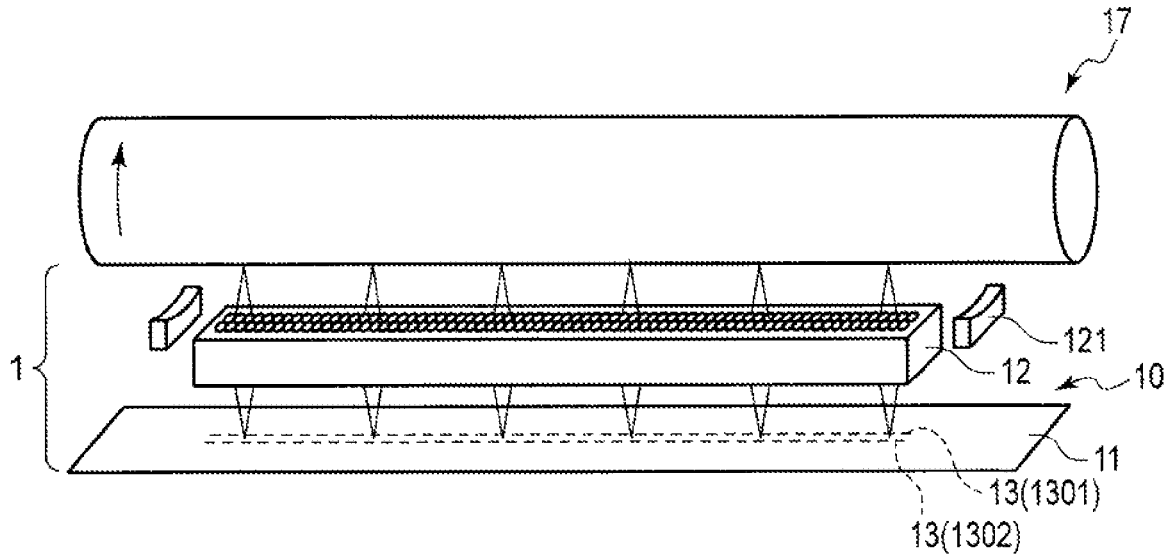
FIG. 1 is a diagram showing an example of the positional relationship between a print head and a photoreceptor drum applied to an image forming apparatus according to an embodiment.

FIG. 1 is a diagram showing an example of the positional relationship between a print head and a photoreceptor drum applied to the image forming apparatus according to the embodiment.

The image forming apparatus includes a photoreceptor drum 17 and a print head 1, which are shown in FIG. 1. The print head 1 is opposed to the photoreceptor drum 17.

The photoreceptor drum 17 rotates in the direction of the arrow shown in FIG. 1. The rotation direction of the photoreceptor drum 17 will be called a sub-scanning direction (Y-axis direction), and the direction orthogonal to the sub-scanning direction will be called a main scanning direction (X-axis direction). The photoreceptor drum 17 is charged uniformly by a charger, and part of the photoreceptor drum 17 is exposed by light from the print head 1 and its potential is lowered. That is, the image forming apparatus controls the light emission of the print head 1 to form an electrostatic latent image on the photoreceptor drum 17. Controlling the light emission of the print head 1 is controlling the timing of light emission and extinction (no light emission) of the print head 1.

The print head 1 includes a light emitting section 10 and a rod lens array 12. The light emitting section 10 includes a transparent board 11. The transparent board 11 is, for example, a glass substrate that transmits light. On the transparent board 11, a light emitting element array 13 including a plurality of light emitting elements is formed.

The print head 1 may include a plurality of light emitting element arrays or a single light emitting element array. For example, as shown in FIG. 1, the print head 1 includes two parallel light emitting element arrays of a first light emitting element array 1301 and a second light emitting element array 1302. The rod lens array 12 condenses light from each of light emitting elements 131 of the first and second light emitting element arrays 1301 and 1302 on the photoreceptor drum 17. Thus, an image line corresponding to the light emission of the light emitting elements 131 is formed on the photoreceptor drum 17. The print head 1 also includes a gap spacer 121. The gap spacer 121 keeps a predetermined distance between the transparent board 11 and the photoreceptor drum 17.

An example of the print head 1 including two light emitting element arrays has been described with reference to FIG. 1. The print head 1 may include a single light emitting element array and, in this case, the rod lens array 12 also corresponds to the single light emitting element array, and light from the single light emitting element array is condensed on the photoreceptor drum 17.

Figure 2:
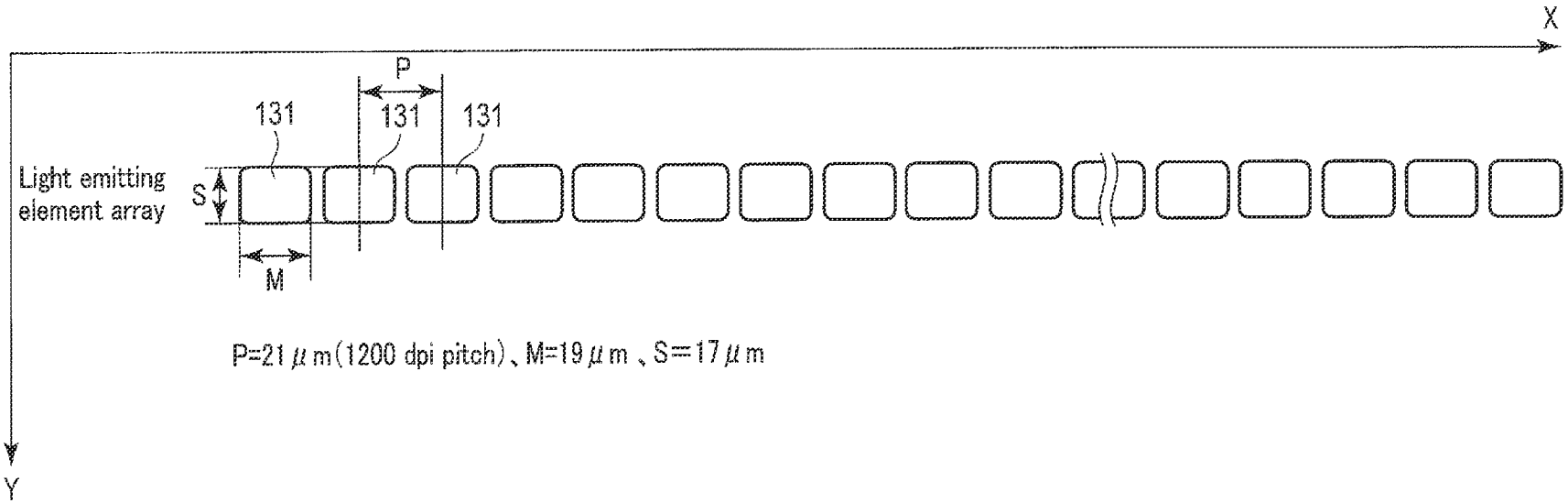
FIG. 2 is a diagram showing an example of a single light emitting element array to configure a print head according to the embodiment.

FIG. 2 is a diagram showing an example of a single light emitting element array to configure the print head according to the embodiment.

As shown in FIG. 2, the main scanning direction (X-axis direction) and the sub-scanning direction (Y-axis direction) orthogonal to the main scanning direction are defined. The light emitting elements 131 are continuously arrayed along the main scanning direction. The IC on the transparent board 11, which will be described later, functions as a light emission control circuit to control the light emission of the light emitting elements 131 through a drive circuit to be described later in units of a light emitting element group. One light emitting element group includes a predetermined number of continuous light emitting elements included in the light emitting elements 131. That is, the light emitting elements 131 are divided and controlled in units of n light emitting element groups from the first group to the n-th (n is a natural number) group.

The light emission control circuit (IC on the transparent board 11) outputs PWM signals of different phases to the drive circuit of each of the light emitting element groups. The drive circuit generates drive signals of different phases, which cause the light emitting elements 131 to emit light individually based on the PWM signals output from the light emission control circuit. An image forming section to be described later forms an image corresponding to the light emission of the light emitting elements 131 based on the drive signals of different phases.

As shown in FIG. 2, the size S of each of the light emitting elements 131 in the sub-scanning direction, the size M thereof in the main scanning direction, and the pitch P between the light emitting elements 131 are defined. For example, the pitch P, size M and size S are as follows.

P=21 μm (1200 dpi pitch)

M=19 μm

S=17 μm

Figure 3:
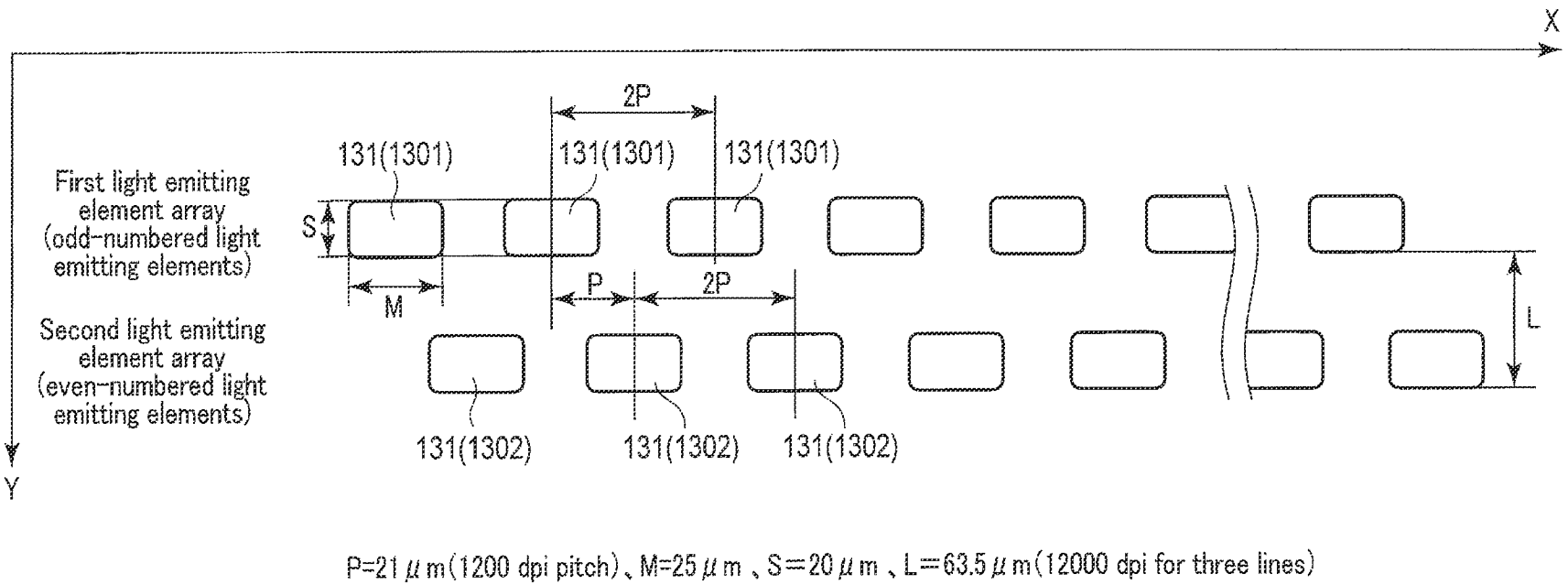
FIG. 3 is a diagram showing an example of two light emitting element arrays to configure the print head according to the embodiment.

FIG. 3 is a diagram showing an example of two light emitting element arrays to configure the print head according to the embodiment.

As shown in FIG. 3, a main scanning direction and a sub-scanning direction orthogonal to the main scanning direction are defined. A plurality of light emitting elements 131 included in the first and second light emitting element arrays 1301 and 1302 are arrayed continuously along the main scanning direction. Assume here that serial numbers from 1 to x are assigned to the light emitting elements 131. In the two light emitting element arrays, the first light emitting element array 1301 includes odd-numbered light emitting elements 131, and the second light emitting element array 1302 includes even-numbered light emitting elements 131. The continuous arrays here mean that the odd-numbered light emitting elements 131 included in the first light emitting element array 1301 and the even-numbered light emitting elements 131 included in the second light emitting element array 1302 are alternately continuous, that is, they are continuous in serial number order.

The IC on the transparent board 11 functions as a light emission control circuit to control the light emission of the light emitting elements 131 through a drive circuit to be described later in units of a light emitting element group. One light emitting element group includes a predetermined number of light emitting elements that are continuous in serial number order. That is, one light emitting element group is provided across the first and second light emitting element arrays 1301 and 1302 and includes a predetermined number of light emitting elements that are continuous in serial number order. That is, the light emitting elements 131 are divided and controlled in units of n light emitting element groups from the first group to the n-th (n is a natural number) group.

The light emission control circuit (IC on the transparent board 11) outputs PWM signals of different phases to a drive circuit of each of the light emitting element groups. The drive circuit generates drive signals of different phases, which cause the light emitting elements 131 to emit light individually based on the PWM signals output from the light emission control circuit. An image forming section to be described later forms an image corresponding to the light emission of the light emitting elements 131 based on the drive signals of different phases.

As shown in FIG. 3, the size S of each of the light emitting elements 131 in the sub-scanning direction, the size M thereof in the main scanning direction, the pitch P between the odd-numbered and even-numbered light emitting elements 131, the pitch 2P between the odd-numbered light emitting elements 131, and the pitch 2P between the even-numbered light emitting elements 131 are defined. For example, the pitch P, size M, size S and length L are as follows.

P=21 μm (1200 dpi pitch)

M=25 μm

S=20 μm

L=63.5 μm (for 3 lines of 1200 dpi)

The light emitting elements 131 included in the first light emitting element array 1301 and the light emitting elements 131 included in the second light emitting element array 1302 are shifted by pitch P in the main scanning direction. In the two light emitting element arrays, the size M in the main scanning direction can be set equal to or larger than the pitch P (M≥P). In other words, the light emission area of the light emitting elements 131 in two arrays can be made larger than that of the light emitting elements 131 in one array.

The life of the light emitting elements 131 is shortened when the current density is increased to increase the light quantity. If the light emission area is increased, the light quantity can be increased without increasing the current density.

Figure 4:
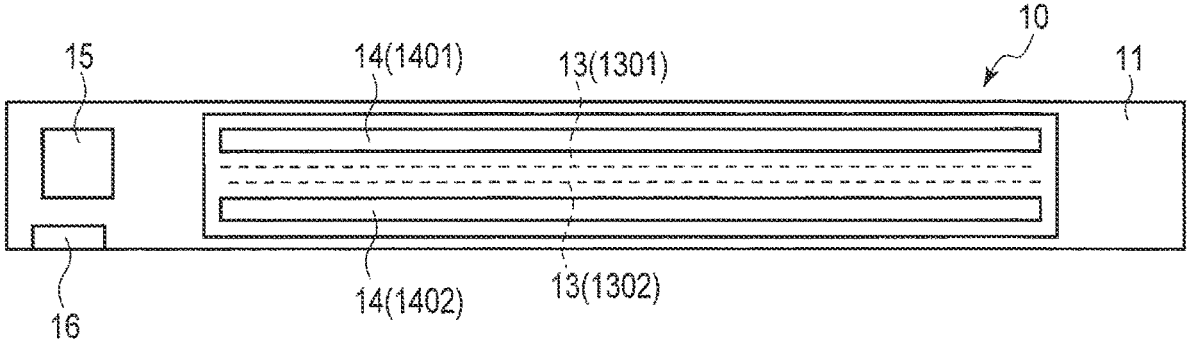
FIG. 4 is a diagram showing an example of a transparent board to configure the print head according to the embodiment.

FIG. 4 is a diagram showing an example of the transparent board to configure the print head according to the embodiment. The transparent board shown in FIG. 4 corresponding to a two light emitting element arrays, but the print head may be configured by a single light emitting element array.

As shown in FIG. 4, two light emitting element arrays 13 (first light emitting element array 1301 and second light emitting element array 1302) are formed in the central part of the transparent board 11 along the longitudinal direction of the transparent board 11. In the vicinity of the light emitting element arrays 13, a drive circuit array 14 (first drive circuit array 1401 and second drive circuit array 1402) is formed to drive each of the light emitting elements (to cause each of the light emitting elements to emit light). Hereinafter, "drive" will be referred to as "DRV." In FIG. 4, a DRV circuit array 14 is placed on either side of the two light emitting element arrays 13 to drive the light emitting elements (to cause the light emitting elements to emit light), but the DRV circuit array 14 may be placed on one side thereof.

At an end portion of the transparent board 11, an integrated circuit (IC) 15 is provided. The transparent board 11 includes a connector 16. The connector 16 electrically connects the print head 1 with a control system of a printer, a copying machine or a multi-functional peripheral. This connection enables power supply, head control, image data transfer, and the like. The transparent board 11 is provided with a substrate to seal the light emitting element arrays 13, DRV circuit array 14 and the like so as not to come into contact with the outside air. If it is difficult to mount the connector on the transparent board, flexible printed circuits (FPC) may be connected to the transparent board and electrically connected to the control system.

Figure 5:
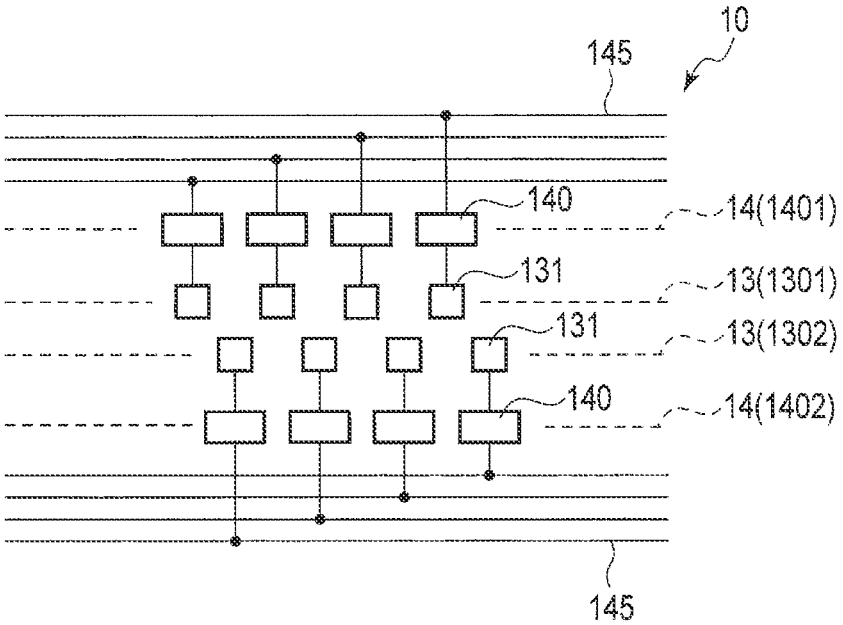
FIG. 5 is a diagram showing an example of a layout of a DRV circuit and light emitting elements of the print head according to the embodiment.

FIG. 5 is a diagram showing an example of a layout of the DRV circuit and light emitting elements of the print head according to the embodiment. The DRV circuit shown in FIG. 5 corresponds to two light emitting element arrays, but the print head may be configured by a single light emitting element array.

As shown in FIG. 5, the light emitting section 10 of the print head 1 includes light emitting element arrays 13 in which a plurality of light emitting elements 131 are arrayed and a DRV circuit array 14 in which a plurality of DRV circuits 140 are arranged. The DRV circuits 140 cause the light emitting elements 131 connected to lines 145 to emit light, based on signals (corresponding to a sample hold signal 21, a light emission level signal 22 and a pulse width modulation (PWM) signal 32, which will be described later) of the lines 145.

Figure 6:
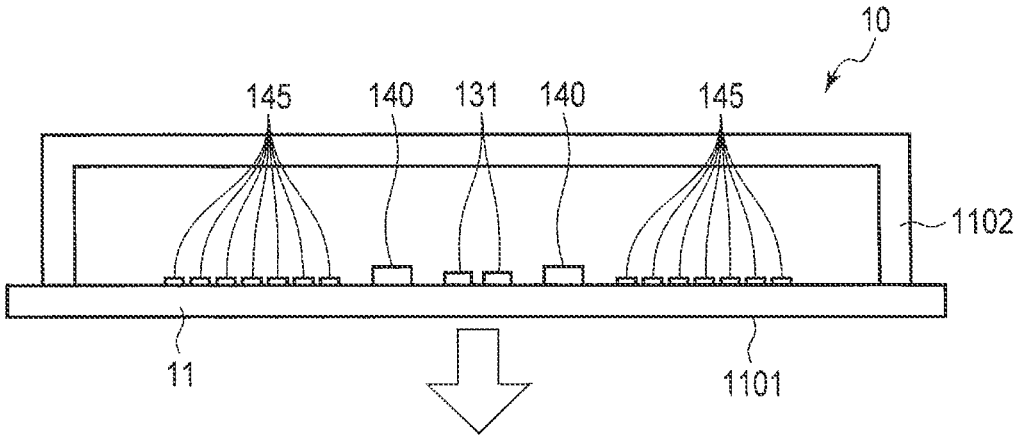
FIG. 6 is a diagram showing an example of a section of a transparent board of the print head according to the embodiment.

FIG. 6 is a diagram showing an example of a section of the transparent board of the print head according to the embodiment. The section of the transparent board corresponds to two light emitting element arrays, but the print head may be configured by a single light emitting element array.

As shown in FIG. 6, the light emitting section 10 of the print head 1 includes a plurality of light emitting elements 131, a plurality of DRV circuits 140 and lines 145, which are opposed to a reference surface 1101 of the transparent board 11. The light emitting section 10 includes sealing glass 1102. The light emitting elements 131, DRV circuits 140 and lines 145 are disposed in a space surrounded by the transparent board 11 and the sealing glass 1102. Light from the light emitting elements 131 is transmitted through the transparent board 11 and is applied to the photoreceptor drum 17.

Figure 7:
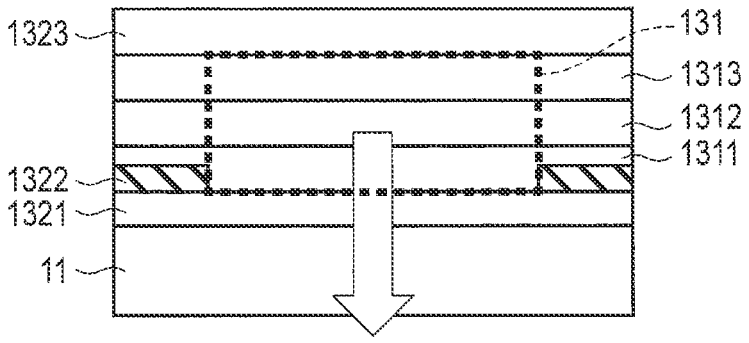
FIG. 7 is a diagram illustrating an example of a structure of a light emitting element of the print head according to the embodiment.

FIG. 7 is a diagram illustrating an example of a structure of a light emitting element of the print head according to the embodiment, using an organic light emitting diode (OLED). In FIG. 7, the sealing glass 1102 is not illustrated.

As shown in FIG. 7, the light emitting element 131 indicated by a broken line includes a hole transport layer 1311, a light emitting layer 1312, and a part of an electron transport layer 1313 in order in the stacking direction. The light emitting element 131 is in contact with an electrode (+) 1321 and an electrode (−) 1323 and is sandwiched therebetween to emit light with a current supplied from the electrodes. The electrode (−) 1323 has a structure of reflecting light emitted from the light emitting layer 1312. Since the current is cut off in the stacking direction by the insulation property of an insulating layer 1322, a portion of the light emitting layer 1312, which is not shadowed by the insulating layer 1322 when viewed from the electrode (+) 1321 toward the stacking direction, emits light, and this portion corresponds to the light emitting element 131. Thus, the shape and size of the light emitting element 131 described above with reference to FIGS. 2 and 3 depend upon the pattern of the insulating layer 1322. With this structure, the light emitted from the light emitting layer 1312 is output toward the transparent board 11.

Figure 8:
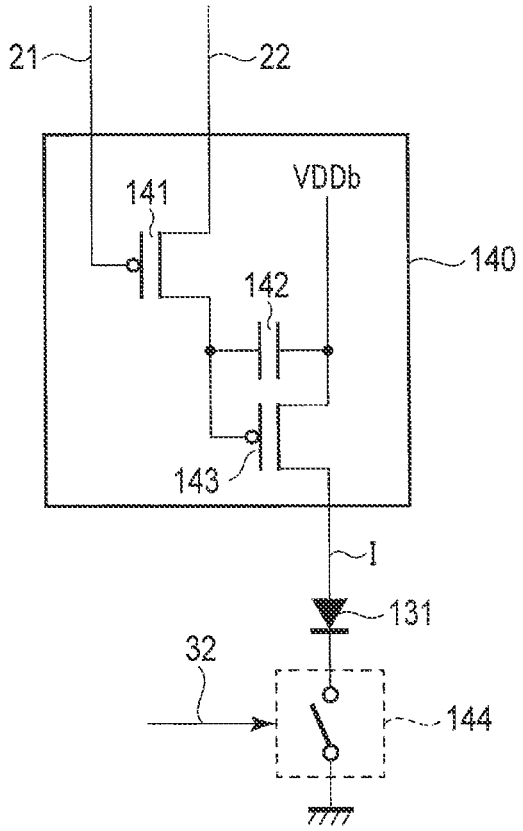
FIG. 8 is a diagram showing an example of a circuit configuration including a DRV circuit that drives the light emitting elements according to the embodiment, light emitting elements that emit light by the DRV circuit, and a switch that selects a current supply to the light emitting elements.

FIG. 8 is a diagram showing an example of a circuit configuration including a DRV circuit that drives the light emitting elements according to the embodiment, light emitting elements that emit light by the DRV circuit, and a switch that selects a current supply to the light emitting elements.

The DRV circuit is configured by a low-temperature polysilicon thin-film transistor. The sample hold signal 21 becomes an "L" level when the light emission intensity of the light emitting element 131 connected to the DRV circuit 140 is changed. When the sample hold signal 21 becomes an "L" level, the voltage of a capacitor 142 varies according to the voltage of the light emission level signal 22. That is, the capacitor 142 holds a potential that varies with correction data to be described later.

When the sample hold signal 21 becomes an "H" level, the voltage of the capacitor 142 is held. Even though the voltage of the light emission level signal 22 changes, the voltage level of the capacitor 142 does not change. A current corresponding to the voltage held in the capacitor 142 flows through the light emitting element 131 connected to a signal line I of the DRV circuit 140. That is, the light emitting element 131 emits light in accordance with the potential of the capacitor. A predetermined light emitting element 131 can be selected from the light emitting elements 131 included in the light emitting element array 13 in response to the sample hold signal 21, and light emission intensity can be determined in response to the light emission level signal 22 to maintain the light emission intensity.

A switch 144 is connected to the DRV circuit 140. The switch 144 selects supply or non-supply of current (on or off of current supply) to the light emitting element 131. When the switch 144 is closed by the PWM signal 32, a current flows through the light emitting element 131, and the light emitting element 131 emits light. When the switch 144 is opened by the PWM signal 32, no current flows through the light emitting element 131, and the light emitting element 131 is turned off.

The DRV circuit 140 and the switch 144 have been described separately with reference to FIG. 8. For descriptions, the switch 144 may be included in the DRV circuit 140 and, in other words, the switch 144 may be included in the wording of "DRV circuit 140."

Figure 9:
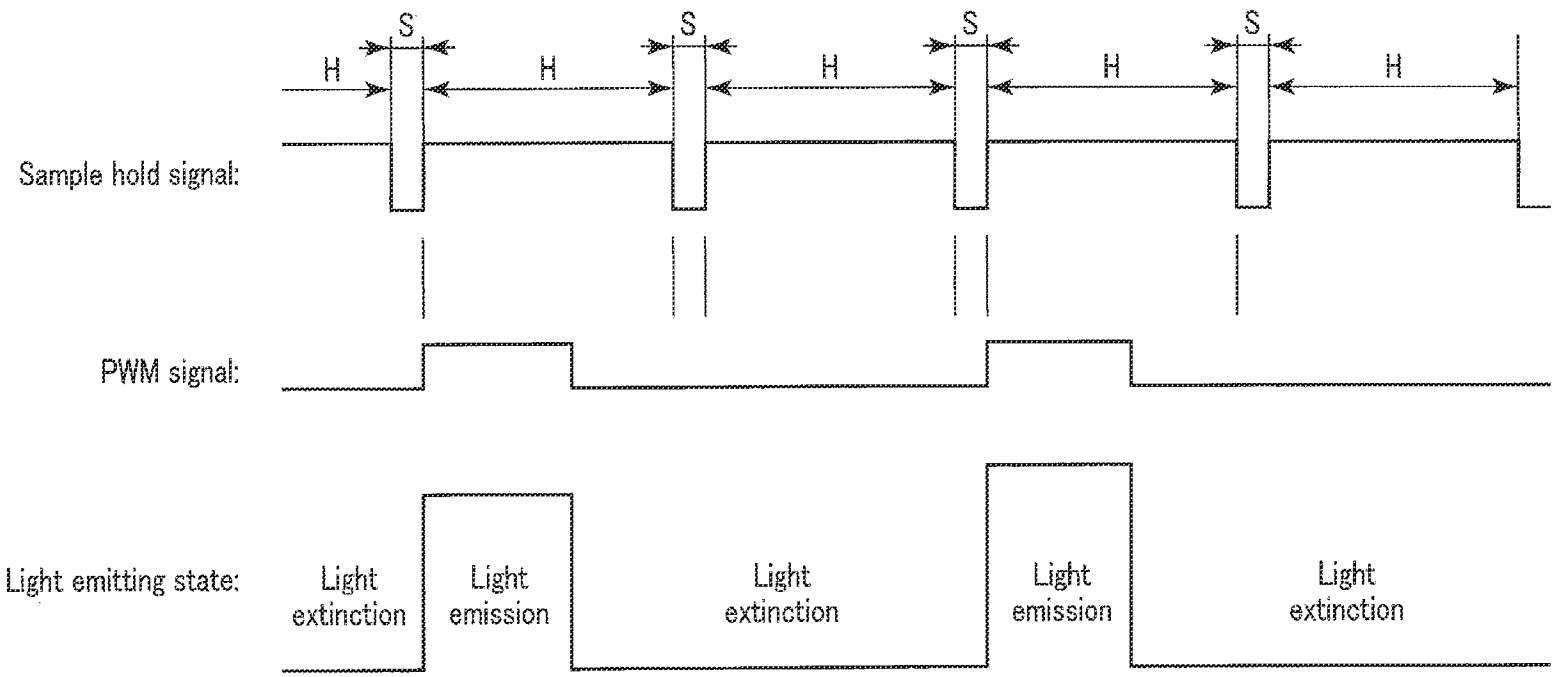
FIG. 9 is a timing chart showing an example of the relationship between sample hold and PWM signals input to the DRV circuit according to the embodiment and the light emitting state of the light emitting element.

FIG. 9 is a timing chart showing an example of the relationship between the sample hold signal 21 and PWM signal 32 input to the DRV circuit 140 according to the embodiment and the light emitting state of the light emitting element 131.

As shown in FIG. 9, the light emitting element 131 emits light to correspond to a hold period of the sample hold signal 21 including a sample period (S) and a hold period (H) and a rising period of the PWM signal 32, and it turns off to correspond to a falling period of the PWM signal 32.

In the sample period (S), a voltage output from a D/A 153 built in the IC 15 is sampled by the capacitor 142 in the DRV circuit. In the hold period (H), the voltage is held. In response to the PWM signal, light is emitted during the hold period (H). Note that the quantity of light emitting elements per line cycle can be changed by changing the width of the PWM signal.

Figure 10:
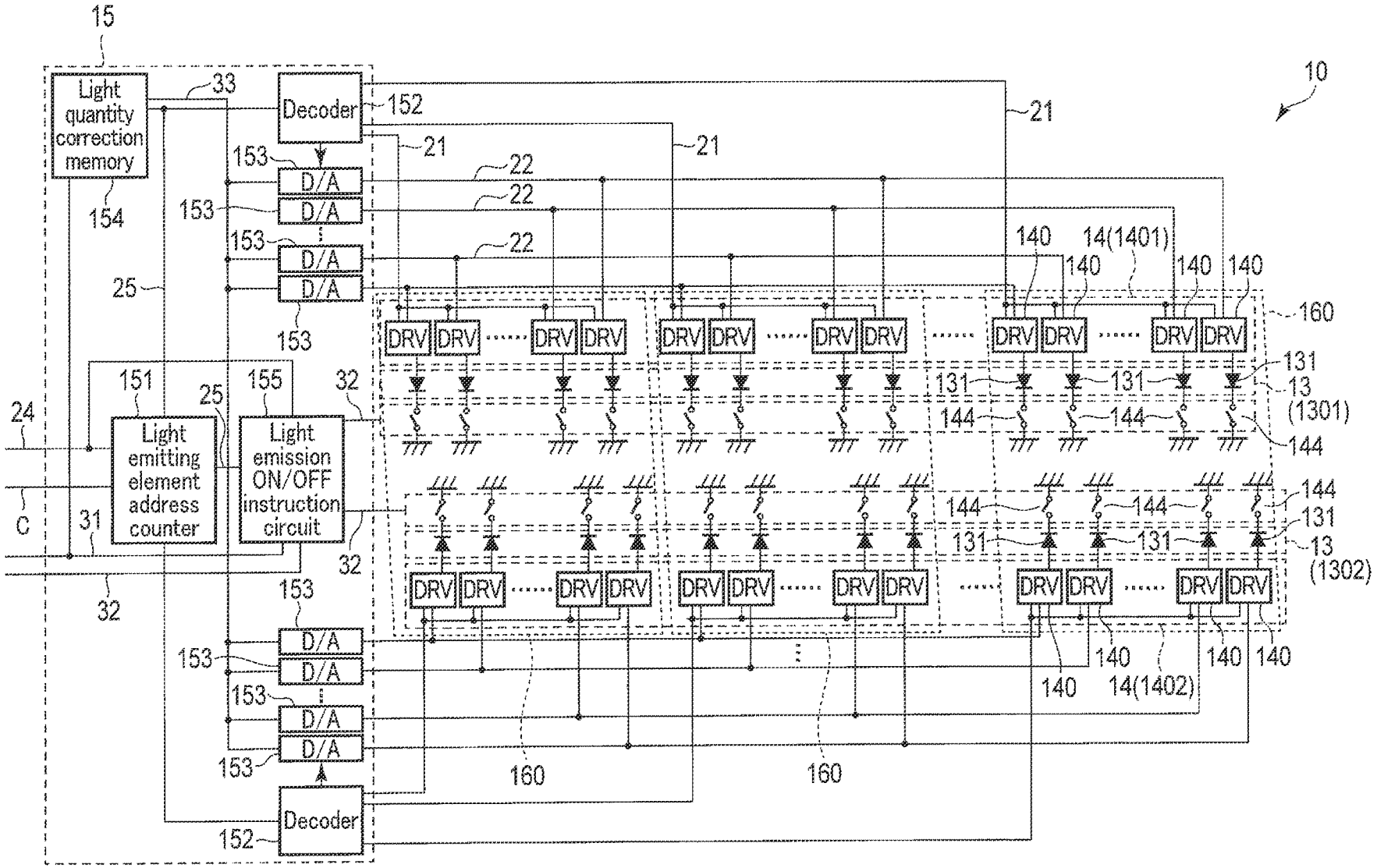
FIG. 10 is a diagram showing an example of a head circuit block of the print head according to the embodiment.

FIG. 10 is a diagram showing an example of a head circuit block of the print head according to the embodiment. The head circuit block shown in FIG. 10 corresponds to a two light emitting element array, but the print head may be configured by a single light emitting element array.

As shown in FIG. 10, the light emitting section 10 includes n light emitting element groups 160 from the first group to the n-th group, and also includes a head circuit block including the IC 15. Note that the light emitting element groups 160 are groups for controlling light emission by the IC 15. The IC 15 functions as a light emission control circuit, and includes a light emitting element address counter 151, a decoder 152, a digital to analog (D/A) conversion circuit 153, a light quantity correction memory 154, a light emission ON/OFF instruction circuit 155, and the like. The light emitting element address counter 151, decoder 152, digital to analog (D/A) conversion circuit 153, light quantity correction memory 154 and light emission ON/OFF instruction circuit 155 supply the sample hold signal 21, light emission level signal 22 and PWM signal 32 described above to the DRV circuit 140 and the like.

As shown in FIG. 10, a light emitting element 131 is connected to a corresponding one of the DRV circuits 140. The DRV circuits 140 function as drive circuits and in units of the light emitting element group 160, generate drive signals for causing the light emitting elements 131 to emit light based on the sample hold signal 21, light emission level signal 22 and PWM signal 32 output from the IC 15. Each of the DRV circuits 140 supplies a drive signal (current) to its corresponding one of the light emitting elements 131. The D/A conversion circuit 153 is connected to the first DRV circuit array 1401 connected to the first light emitting element array 1301. Similarly, the D/A conversion circuit 153 is connected to the second DRV circuit array 1402 connected to the second light emitting element array 1302.

The light quantity correction memory 154 stores correction data corresponding to a current flowing through each of the light emitting elements 131. The light emitting element address counter 151 is supplied with a horizontal synchronization signal 24 and an image data write clock C through a connector 16. The horizontal synchronization signal 24 resets the count value of the light emitting element address counter 151. The light emitting element address counter 151 outputs a light emitting element address signal 25 synchronized with the image data write clock C.

The light quantity correction memory 154 is supplied with image data 31 and the light emitting element address signal 25 from the light emitting element address counter 151. The decoder 152 is supplied with the light emitting element address signal 25 from the light emitting element address counter 151. The decoder 152 outputs a sample hold signal 21 corresponding to a light emitting element 131 designated by the light emitting element address signal 25. The light quantity correction memory 154 outputs correction data 33 corresponding to a light emitting element 131 designated by the light emitting element address signal 25. The D/A conversion circuit 153 is supplied with the correction data 33 from the light quantity correction memory 154. The D/A conversion circuit 153 outputs a voltage of the light emission level signal 22 based on the correction data 33. The voltage of the light emission level signal 22 is sampled and held in the capacitor 142 of the DRV circuit 140. The sample and hold in the capacitor 142 is periodically performed.

[Configuration of Image Forming Apparatus]

Figure 11:
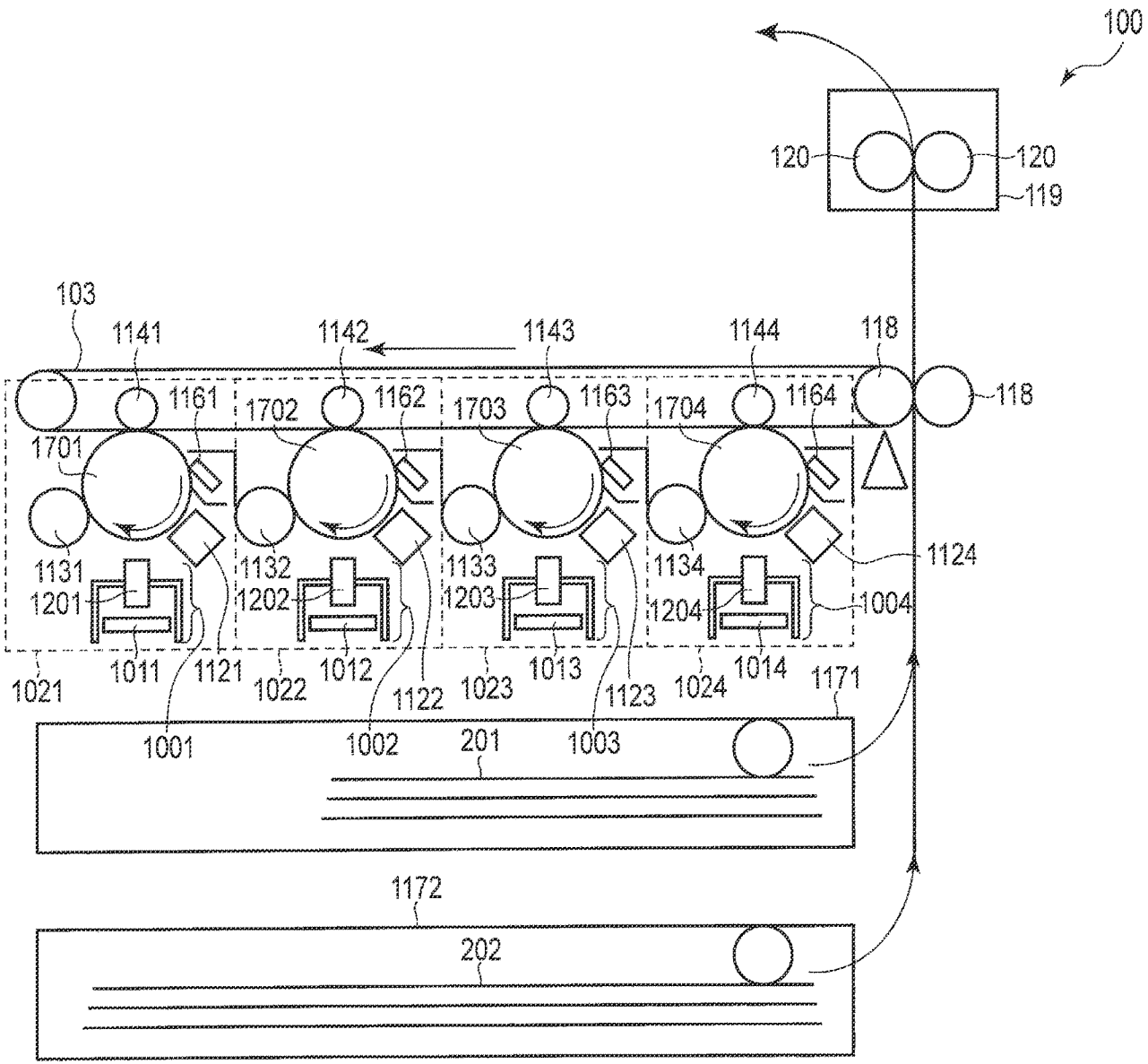
FIG. 11 is a diagram showing an example of an image forming apparatus to which the print head according to the embodiment is applied.

FIG. 11 is a diagram showing an example of an image forming apparatus to which the print head according to the present embodiment is applied. The image forming apparatus shown in FIG. 11 is a four-tandem color image forming apparatus, but the print head 1 of the embodiment can also be applied to a monochrome image forming apparatus.

As shown in FIG. 11, for example, the image forming apparatus 100 includes an image forming unit 1021 which forms a yellow (Y) image, an image forming unit 1022 which forms a magenta (M) image, an image forming unit 1023 which forms a cyan (C) image, and an image forming unit 1024 which forms a black (K) image. The image forming units 1021, 1022, 1023 and 1024 respectively form yellow, cyan, magenta and black images and transfer them to a transfer belt 103. Thus, a full-color image is formed on the transfer belt 103.

The image forming unit 1021 which forms a yellow (Y) image includes a print head 1001, and the print head 1001 includes a light emitting section 1011 and a rod lens array 1201. The image forming unit 1021 also includes a charger 1121, a print head 1001, a developing device 1131, a transfer roller 1141 and a cleaner 1161 around a photoreceptor drum 1701. Since the print head 1001 corresponds to the print head 1, the light emitting section 1011 corresponds to the light emitting section 10, the rod lens array 1201 corresponds to the rod lens array 12, and the photoreceptor drum 1701 corresponds to the photoreceptor drum 17, their descriptions will be omitted.

The image forming unit 1022 which forms a magenta (M) image includes a print head 1002, and the print head 1002 includes a light emitting section 1012 and a rod lens array 1202. The image forming unit 1022 also includes a charger 1122, a print head 1002, a developing device 1132, a transfer roller 1142 and a cleaner 1162 around a photoreceptor drum 1702. Since the print head 1002 corresponds to the print head 1, the light emitting section 1012 corresponds to the light emitting section 10, the rod lens array 1202 corresponds to the rod lens array 12, and the photoreceptor drum 1702 corresponds to the photoreceptor drum 17, their descriptions will be omitted.

The image forming unit 1023 which forms a cyan (C) image includes a print head 1003, and the print head 1003 includes a light emitting section 1013 and a rod lens array 1203. The image forming unit 1023 also includes a charger 1123, a print head 1003, a developing device 1133, a transfer roller 1143 and a cleaner 1163 around a photoreceptor drum 1703. Since the print head 1003 corresponds to the print head 1, the light emitting section 1013 corresponds to the light emitting section 10, the rod lens array 1203 corresponds to the rod lens array 12, and the photoreceptor drum 1703 corresponds to the photoreceptor drum 17, their descriptions will be omitted.

The image forming unit 1024 which forms a black (K) image includes a print head 1004, and the print head 1004 includes a light emitting section 1014 and a rod lens array 1204. The image forming unit 1024 also includes a charger 1124, a print head 1004, a developing device 1134, a transfer roller 1144 and a cleaner 1164 around a photoreceptor drum 1704. Since the print head 1004 corresponds to the print head 1, the light emitting section 1014 corresponds to the light emitting section 10, the rod lens array 1204 corresponds to the rod lens array 12, and the photoreceptor drum 1704 corresponds to the photoreceptor drum 17, their descriptions will be omitted.

The chargers 1121, 1122, 1123 and 1124 uniformly charge the photoreceptor drums 1701, 1702, 1703 and 1704, respectively. The print heads 1001, 1002, 1003 and 1004 expose their respective photoreceptor drums 1701, 1702, 1703 and 1704 by the light emission of the light emitting elements 131 of the first and second light emitting element arrays 1301 and 1302 to form electrostatic latent images on the photoreceptor drums 1701, 1702, 1703 and 1704. The developing devices 1131, 1132, 1133 and 1134 transfer yellow toner, magenta toner, cyan toner and black toner to electrostatic latent image portions of the photoreceptor drums 1701, 1702, 1703 and 1704, respectively (develop toner images).

The transfer rollers 1141, 1142, 1143 and 1144 transfer the toner images developed on the photoreceptor drums 1701, 1702, 1703 and 1704 to the transfer belt 103. The cleaners 1161, 1162, 1163 and 1164 clean the toner which remains on the photoreceptor drums 1701, 1702, 1703, and 1704 without being transferred, thus standing by to form a next image.

Sheets 201 of a first size (small size) (on which an image is to be formed) are stored in a sheet cassette 1171 that is a sheet supply means. Sheets 202 of a second size (large size) (on which an image is to be formed) are stored in a sheet cassette 1172 that is a sheet supply means.

A toner image is transferred from the transfer belt 103 to the sheets 201 or 202 removed from the sheet cassette 1171 or 1172 by a pair of transfer rollers 118 that are transfer means. The sheets 201 or 202 to which the toner image is transferred are heated and pressed by a fixing roller 120 of a fixing section 119. The toner image is thus fixed to the sheets 201 or 202. If the foregoing process is repeated, the image forming operation is continuously performed.

Figure 12:
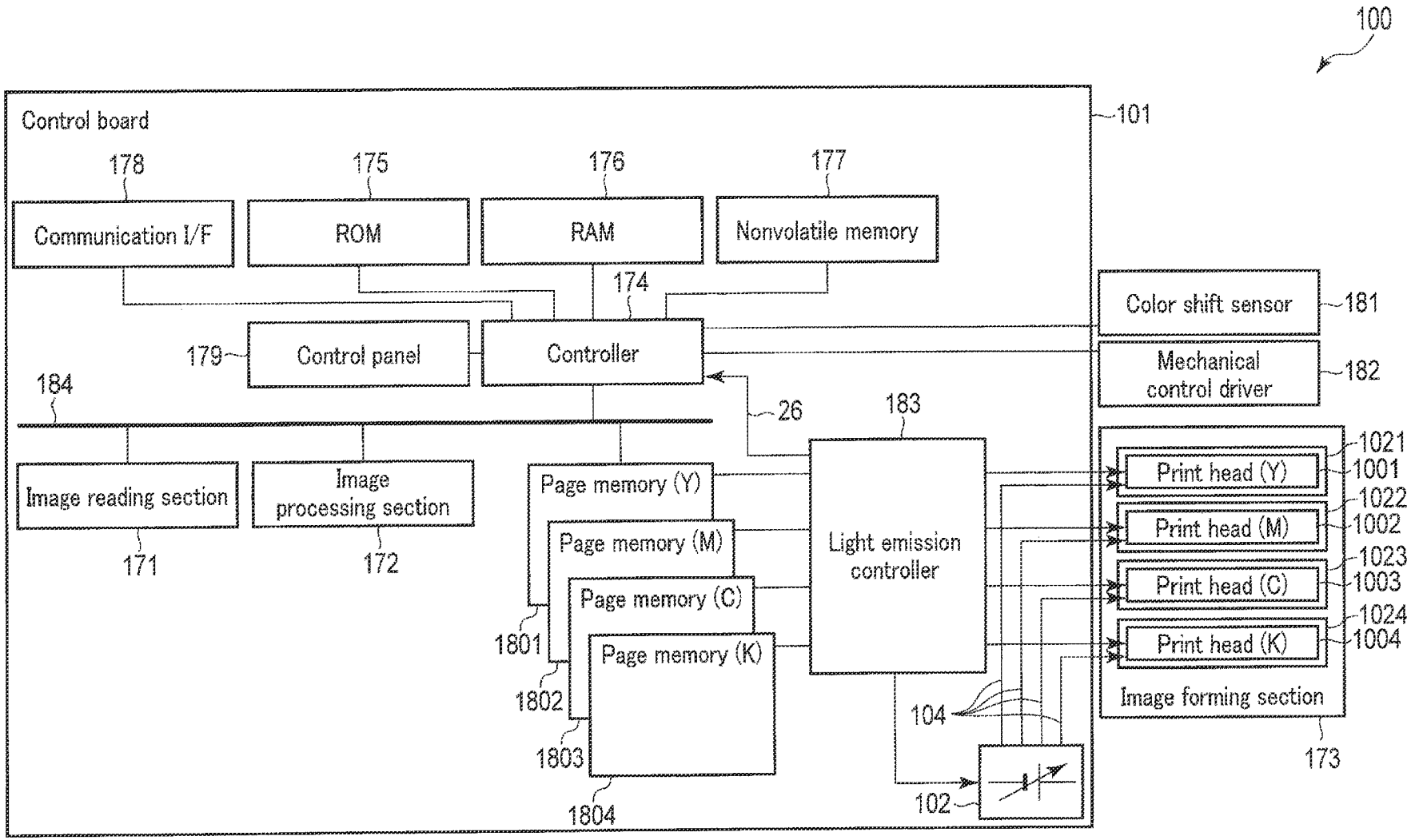
FIG. 12 is a block diagram showing an example of a control system of the image forming apparatus according to the embodiment.

FIG. 12 is a block diagram showing an example of the control system of the image forming apparatus according to the embodiment.

As shown in FIG. 12, the image forming apparatus 100 includes a control board 101. The control board 101 includes a power supply section 102, an image reading section 171, an image processing section 172, a controller 174, a read only memory (ROM) 175, a random access memory (RAM) 176, a nonvolatile memory 177, a communication I/F 178, a control panel 179, page memories 1801, 1802, 1803 and 1804, a light emitting controller 183, and an image data bus 184. The image forming apparatus 100 further includes a color shift sensor 181 and a mechanical control driver 182. An image forming section 173 includes image forming units 1021, 1022, 1023 and 1024. The power supply section 102 supplies a drive voltage to the print heads 1001, 1002, 1003 and 1004 of the image forming section 173 through a harness 104.

The ROM 175, RAM 176, nonvolatile memory 177, communication I/F 178, control panel 179, color shift sensor 181, mechanical control driver 182 and light emitting controller 183 are connected to the controller 174.

The image reading section 171, image processing section 172, controller 174 and page memories 1801, 1802, 1803 and 1804 are connected to the image data bus 184. The page memories 1801, 1802, 1803 and 1804 output image data 31 of Y, M, C and K, respectively. The light emitting controller 183 is connected to the page memories 1801, 1802, 1803 and 1804 to receive image data 31 of Y from the page memory 1801, image data 31 of M from the page memory 1802, image data 31 of C from the page memory 1803 and image data 31 of K from the page memory 1804. The print heads 1001, 1002, 1003 and 1004 are connected to the light emitting controller 183. The light emitting controller 183 inputs image data 31 of Y, M, C and K to the print heads 1001, 1002, 1003 and 1004, respectively.

The controller 174 is configured by one or more processors to control operations such as image reading, image processing and image formation along a variety of programs stored in at least one of the ROM 175 and the nonvolatile memory 177.

The controller 174 supplies test pattern image data onto the page memories 1801, 1802, 1803 and 1804 to form a test pattern. The color shift sensor 181 senses a test pattern formed on the transfer belt 103 and outputs a sensing signal to the controller 174. In response to the sensing signal from the color shift sensor 81, the controller 174 can recognize a positional relationship among test patterns of respective colors. In addition, the controller 174 selects one of the sheet cassettes 1171 and 1172, which feed sheets to form an image, through the mechanical control driver 182.

The ROM 175 stores, for example, various programs necessary for controlling the controller 174. The programs include a print head light emission control program. The light emission control program is a program for controlling the timing of light emission and extinction (no light emission) based on image data.

The RAM 176 temporarily stores data necessary for the control of the controller 174. The nonvolatile memory 177 stores some or all of various programs, various parameters, and the like.

The mechanical control driver 182 receives an instruction from the controller 174 to control an operation of, e.g., a motor required for printing. The communication I/F 178 outputs various items of information to the outside and receives various items of information from the outside. For example, the communication I/F 178 acquires image data including a plurality of image lines. The image forming apparatus 100 prints image data acquired via the communication I/F 178 by a printing function. The control panel 179 receives an instruction about operations from a user and a service person.

The image reading section 171 optically reads an image of the original, acquires image data including a plurality of image lines, and outputs the image data to the image processing section 172. The image processing section 172 performs various types of image processing such as correction to image data received via the communication I/F 178 or image data from the image reading section 171. The page memories 1801, 1802, 1803 and 1804 store the image data processed by the image processing section 172. The controller 174 edits the image data on the page memories 1801, 1802, 1803 and 1804 so as to match a print position and a print head. The image forming section 173 forms an image on the basis of image data stored in the page memories 1801, 1802, 1803 and 1804. In other words, the image forming section 173 forms an image on the basis of the light emission (light emission and extinction states) of each of the light emitting elements 131 corresponding to the image data.

The light emitting controller 183 is configured by one or more processors to control the light emission of the light emitting elements 131 based on image data in accordance with a variety of programs stored in at least one of the ROM 175 and the nonvolatile memory 177. That is, the light emitting controller 183 outputs a drive signal for causing the light emitting elements 131 to emit light to the light emitting elements 131 at predetermined timing.

[Light Emission Control]

Figure 13:
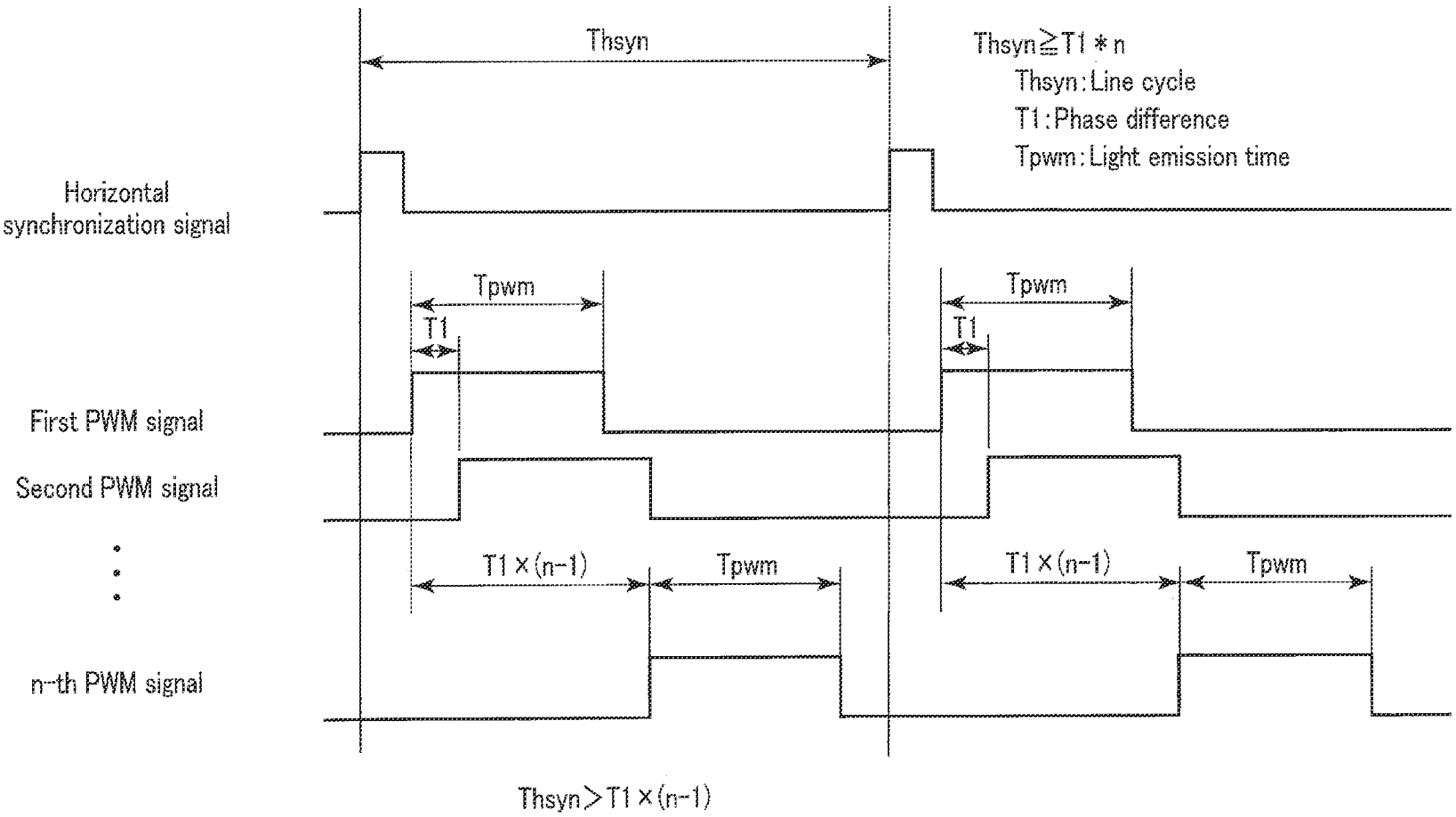
FIG. 13 is a timing chart showing an example of light emission timing of the light emitting elements in a single array of the print head according to the embodiment.

FIG. 13 is a timing chart showing an example of light emission timing of the light emitting elements in a single array of the print head according to the embodiment. The light emission timing chart shows the light emission timing of the light emitting elements based on image data including a linear image along the main scanning direction. That is, the light emission timing chart corresponds to linear image formation.

As shown in FIG. 13, a horizontal synchronization signal, first to n-th PWM signals, a line cycle Thsyn, a phase difference T1, and light emission time Tpwm are defined. The first to n-th PWM signals are signals supplied to the first to n-th light emitting element groups 160. The line cycle Thsyn is a line cycle of the horizontal synchronization signal. The phase difference T1 is a phase difference between PWM signals of two adjacent light emitting element groups 160. The light emission time Tpwm of PWM signal of the m-th light emitting element group 160 (m is a natural number, m n) is the light emission time of the light emitting elements 131 included in the m-th light emitting element group 160. For example, the line cycle Thsyn is longer than the product of the phase difference T1 and the number (n−1) of light emitting element groups 160 (Thsyn>T1×(n−1)).

The light emitting controller 183 on the control board 101 outputs a horizontal synchronization signal, image data and a clock onto the IC 15 on the transparent board 11 of the print head 1. The IC 15 functions as a light emission control circuit, and outputs PWM signals and first to n-th sample hold signals having different phases synchronized with the horizontal synchronization signal to the DRV circuit 140 of each of the light emitting element group 160. Note that the PWM signals output from the IC 15 to the DRV circuit 140 depend on the image data output from the light emitting controller 183. That is, when the image data is data that does not cause a light emitting element 131 corresponding to the image data to emit light, the IC 15 does not output a PWM signal to a DRV circuit 140 corresponding to the image data. In addition, the D/A output voltage of the IC 15 varies in synchronization with the first to n-th sample hold signals along each correction data to adjust a capacitor voltage in the DRV circuit 140. The DRV circuit 140 of each of the light emitting element groups 160 functions as a drive circuit, generates a drive signal based on the input D/A output voltage, sample hold signal and PWM signal, and outputs the drive signal to the light emitting element. Described above is the case where light emission and no light emission of light emitting elements 131 are controlled by PWM signals respectively input to the DRV circuits 140; however, the embodiment is not limited to this. For example, it is possible to input a common PWM signal to the DRV circuits 140 in the same light emitting element group 160, and control light emission and no light emission of each light emitting element 130 corresponding image data with a D/A output voltage. Namely, the PWM signal controls light emission timing of the light emitting element group 160. The D/A output voltage controls light emission and no light emission of each light emitting element 131 with its voltage. The number of PWM signals (lines) can be reduced to the number of light emitting element groups by the IC 15 outputting a common PWM signal to the DRV circuits 140 in the same light emitting element group 160.

As shown in FIG. 13, the first to n-th PWM signals include different light emission times Tpwn. The IC 15 prevents a current from fluctuating greatly by providing a time difference (phase difference) between the start and end of light emission of the light emitting elements 131 included in each of the light emitting element groups 160. The IC 15 supplies the DRV circuit 140 of each of the light emitting element groups 160 with the first to n-th PWM signals having a phase difference to meet the condition that the product of the phase difference T1 and the number (n−1) is less than the line cycle Thsyn (Thsyn>T1×(n−1)) such that the light emitting elements 131 of all of the light emitting element groups 160 can start to emit light in the range of the line cycle Thsyn.

Assuming that the line cycle Thsyn is equal to 188 μs, the phase difference is equal to 1 μs and the number n is equal to 70, the product of the phase difference T1 and the number (n−1) is 69 μs, which is less than 188 μs of the line cycle Thsyn.

Figure 14:
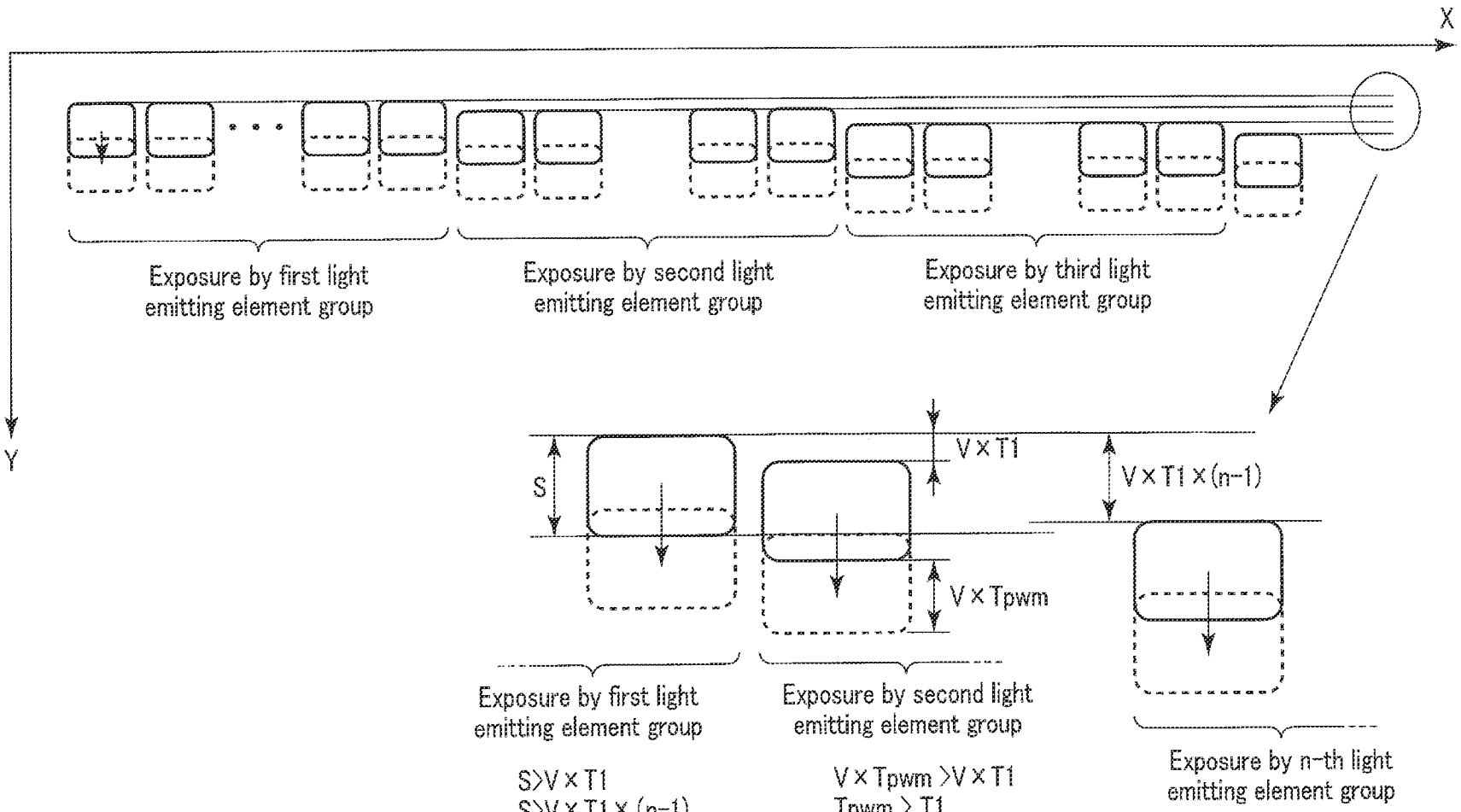
FIG. 14 is a diagram showing an example of an image exposed on a photoreceptor drum by the light emitting elements in a single array of the print head according to the embodiment.

FIG. 14 is a diagram showing an example of an image exposed on the photoreceptor drum by the light emitting elements in a single array of the print head according to the embodiment. The exposed image represents an exposure state of the photoreceptor drum based on image data including a linear image along the main scanning direction. That is, the exposed image corresponds to linear image formation.

As shown in FIG. 14, size S, phase difference T1, light emission time Tpwm, and velocity V are defined. The velocity V is the surface velocity of the photoreceptor drum 17 in the sub-scanning direction. The controller 174 controls the rotation (rotational speed) of the photoreceptor drum 17. The size S is larger than the product of the velocity V and the phase difference T1 (S>V×T1). The size S is also larger than the product of the velocity V, the phase difference T1 and the number (n−1) (S>V×T1×(n−1)). In addition, the light emission time Tpwm is larger than the phase difference T1 (Tpwm>T1).

Assuming that the size S is equal to 17 μm, the velocity V is equal to 112.5 mm/s, the phase difference is equal to 1 μs, the number n is equal to 70, and the light emission time Tpwm is equal to 100 μs, the product of the velocity V and the phase difference T1 is 0.1125 μm, which is sufficiently smaller than the size S of 17 μm. The product of the velocity V, the phase difference T1 and the number n−1 is 7.7625 μm, which is smaller than the size S of 17 μm. The light emission time Tpwm is larger than the phase difference T1 (100 μs>1 μs).

Figure 15:
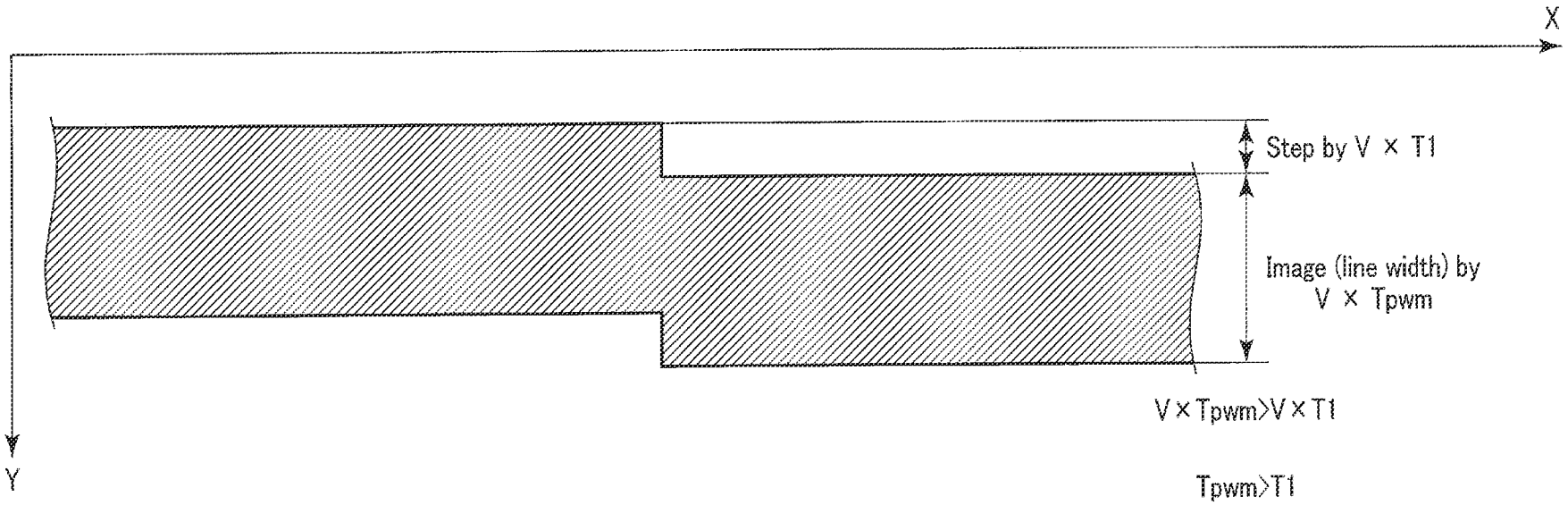
FIG. 15 is a diagram showing an example of an image formed by two adjacent light emitting element groups of the print head according to the embodiment.

FIG. 15 is a diagram showing an example of an image formed by two adjacent light emitting element groups of the print head according to the embodiment. This image represents a linear image along the main scanning direction.

As shown in FIG. 15, a line width is determined by V×Tpwm, and a step is determined by V×T1. The step is smaller than the line width (V×Tpwm>V×T1). That is, the light emission time Tpwm is larger than the phase difference T1 (Tpwm>T1). The PWM signal output from the IC 15 makes the step smaller than the line width.

Figure 16:
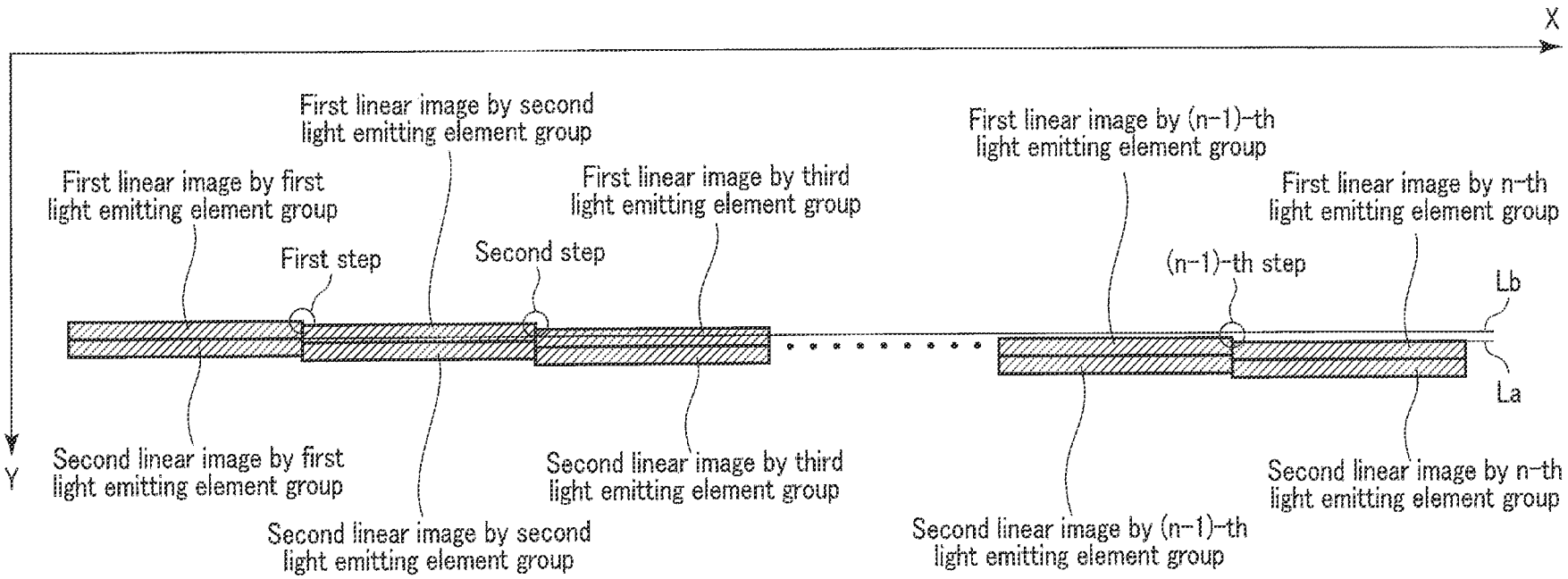
FIG. 16 is a diagram showing an example of an image formed by n light emitting element groups of the print head according to the embodiment.

FIG. 16 is a diagram showing an example of an image formed by n light emitting element groups of the print head according to the embodiment. This image represents a linear image along the main scanning direction.

As shown in FIG. 16, the first, second, third, . . . , (n−1)-th, and n-th light emitting element groups 160 form first and second linear images which are continuous in the sub-scanning direction. A step occurs in the sub-scanning direction between the linear images formed by two adjacent light emitting element groups 160. While the number of light emitting element groups 160 is n, the number of steps is (n−1).

A first step is caused between a first linear image formed by the first light emitting element group 160 and a first linear image formed by the second light emitting element group 160. A second step is caused between the first linear image formed by the second light emitting element group 160 and a first linear image formed by a third light emitting element group 160. A (n−1)-th step is caused between a first linear image formed by the (n−1)-th light emitting element group 160 and a first linear image formed by the n-th light emitting element group 160. Similarly, a step is caused with respect to a second linear image.

The light emitting elements 131 included in the same light emitting element group 160 emit light with the same timing. Thus, no step is caused in the first and second linear images formed by the light emission of the light emitting elements 131 included in the same light emitting element group 160. The size of the step and the number of the steps caused by the difference in light emission timing can be controlled to the minimum by controlling light emission timing of the light emitting element group 160 configured by such continuous light emitting elements 131 in the order of arrangement in units of groups.

In contrast to the first linear image formed by the first light emitting element group 160, the first linear image formed by the n-th light emitting element group 160 is shifted by V×T1×(n−1) in the sub-scanning direction. Assume, for example, a case to satisfy a condition that the line cycle Thsyn is smaller than the product of the phase difference T1 and the number (n−1) (Thsyn<T1×(n−1)). In this case, an upper-side line La of the first linear image formed by the n-th light emitting element group 160 shifts below a lower-side line Lb of the second linear image formed by the first light emitting element group 160.

The IC 15 thus outputs a PWM signal which satisfies the following condition to a horizontal synchronization signal.

$$V\times \mathrm{Thsyn} > V\times T1\times(n-1)$$

That is, the IC 15 outputs a horizontal synchronization signal and a PWM signal which satisfy the following condition.

$$\mathrm{Thsyn} > T1\times(n-1)$$

Accordingly, the amount of shift between the first linear image formed by the first light emitting element group 160 and the first linear image formed by the n-th light emitting element group 160 in the sub-scanning direction is suppressed below 1 line.

The phase difference T1 may be reduced to suppress the amount of shift, but when the phase difference T1 is extremely small, the shortage of sample time makes it difficult to maintain the accuracy of the light emission control and may degrade the quality of images. The present embodiment can prevent the quality of images from being degraded because the accuracy of the light emission control can be maintained, without excessively reducing the phase difference T1, by satisfying the above conditions.

In addition, the number of steps may be decreased by decreasing the total number of light emitting element groups 160. However, it is conceivable that the total number of light emitting elements 131 included in one light emitting element group 160 increases to thereby increase the circuit scale and the number of lines. The present embodiment can prevent the quality of images from being degraded, without excessively decreasing the total number of light emitting element groups 160, by satisfying the foregoing conditions.

Figure 17:
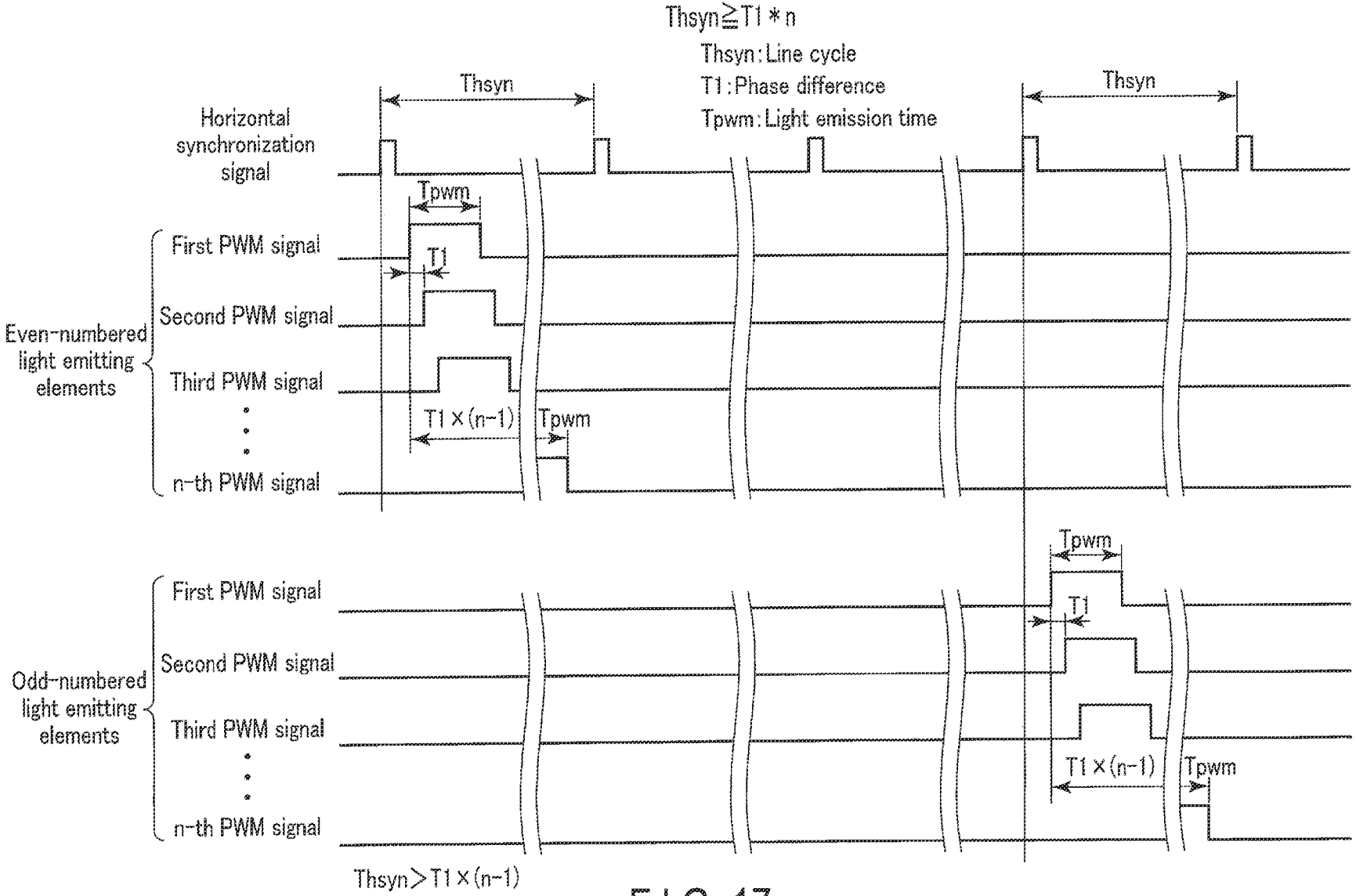
FIG. 17 is a timing chart showing an example of light emission timing of the light emitting elements in two arrays of the print head according to the embodiment.

FIG. 17 is a timing chart showing an example of light emission timing of the light emitting elements in two arrays of the print head according to the embodiment. The timing chart shows the light emission timing of the light emitting elements based on image data including a linear image along the main scanning direction. That is, the timing chart corresponds to linear image formation.

The even-numbered light emitting elements 131 and the odd-numbered light emitting elements 131 are arranged to be shifted by a predetermined length in the sub-scanning direction. Therefore, each of the light emitting element groups 160 including the even-numbered light-emitting elements 131 emits light, and after a predetermined time corresponding to the shift of a predetermined length has elapsed, each of the light emitting element groups 160 including the odd-numbered light emitting elements 131 emits light.

As shown in FIG. 17, a horizontal synchronization signal, first to n-th PWM signals, a line cycle Thsyn, a phase difference T1, and emission time Tpwm are defined.

The light emitting controller 183 functions as a light emission control circuit and outputs a horizontal synchronization signal, image data and a clock to the IC 15. The IC 15 thus outputs PWM signals and first to n-th sample hold signals having different phases, which are synchronized with the horizontal synchronization signal, to the DRV circuit 140 and the switch 144 corresponding to the odd-numbered and even-numbered light emitting elements 131 of each of the light emitting element groups 160. That is, the IC 15 functions as a light emission control circuit. The DRV circuit 140 of each of the light emitting element groups 160 functions as a drive circuit to generate a drive signal based on the first to n-th sample hold signals, PWM signals, etc. and outputs the drive signal to the light emitting elements. This is the operation described above with reference to FIG. 8.

As shown in FIG. 17, the PWM signals output to each of the light emitting element groups 160 include light emission times Tpwn of different timing. The IC 15 prevents a current from fluctuating greatly by providing a time difference (phase difference) between the start and end of light emission of the light emitting elements 131 included in each of the light emitting element groups 160. The IC 15 supplies the DRV circuit 140 with the first to n-th PWM signals having a phase difference to meet the condition that the product of the phase difference T1 and the number (n−1) is less than the line cycle Thsyn (Thsyn>T1×(n−1)) such that each of the light emitting element groups 160 including even-numbered light emitting elements 131 can emit light in the range of the line cycle Thsyn. Similarly, the IC 15 supplies the DRV circuit 140 with the first to n-th PWM signals having a phase difference to meet the condition that the product of the phase difference T1 and the number (n−1) is less than the line cycle Thsyn (Thsyn>T1×(n−1)) such that each of the light emitting element groups 160 including odd-numbered light emitting elements 131 can emit light in the range of the line cycle Thsyn.

Figure 18:
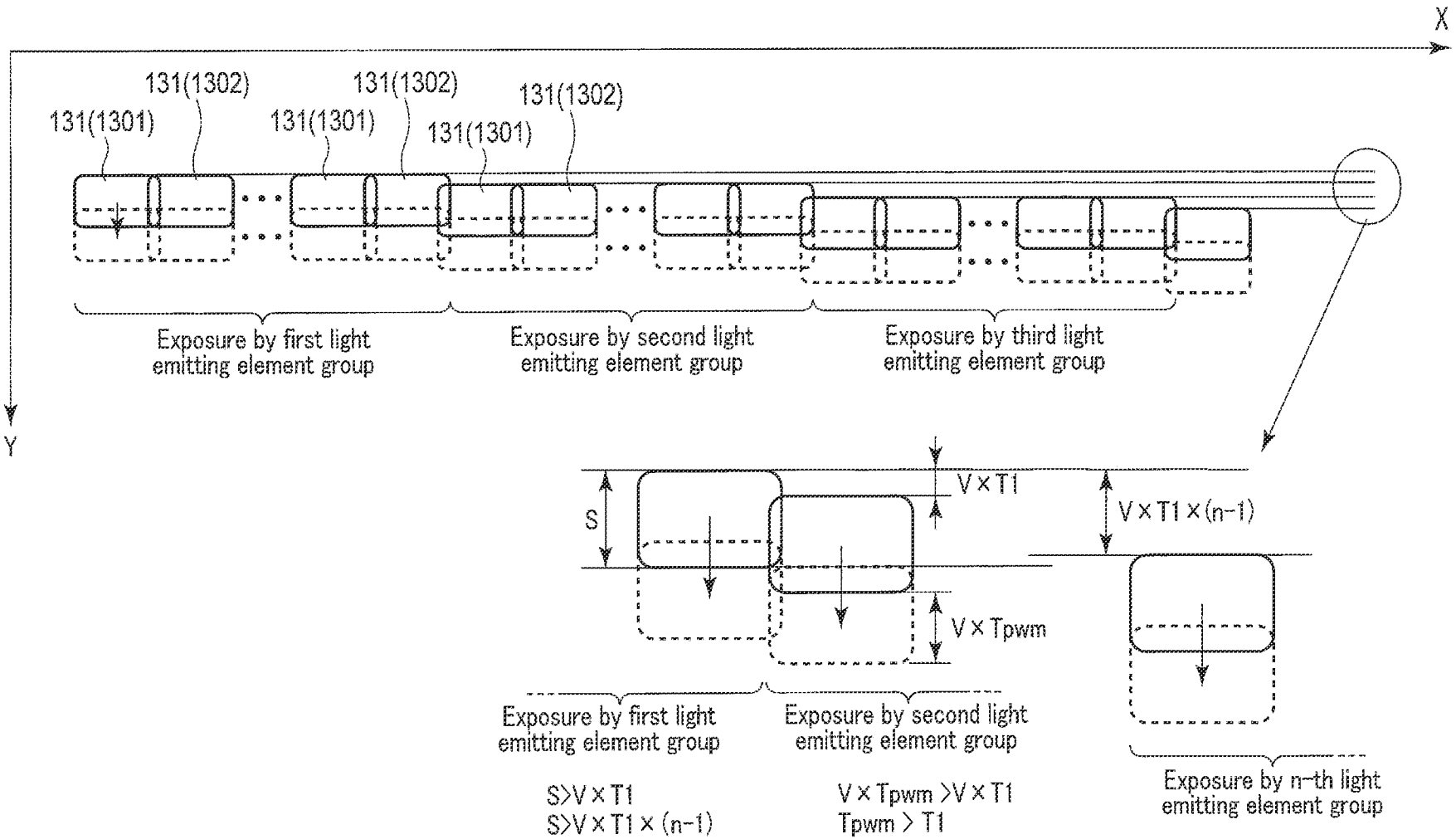
FIG. 18 is a diagram showing an example of an image exposed on the photoreceptor drum by the light emitting elements in two arrays of the print head according to the embodiment.

FIG. 18 is a diagram showing an example of an image exposed on the photoreceptor drum by the light emitting elements in two arrays of the print head according to the embodiment. The exposed image represents an exposure state of the photoreceptor drum based on image data including a linear image along the main scanning direction. That is, the exposed image corresponds to linear image formation.

As shown in FIG. 18, size S, phase difference T1, light emission time Tpwm, and velocity V are defined. The velocity V is the surface velocity of the photoreceptor drum in the sub-scanning direction. The size S is larger than the product of the velocity V and the phase difference T1 (S>V×T1). The size S is also larger than the product of the velocity V, the phase difference T1 and the number (n−1) (S>V×T1×(n−1)). In addition, the light emission time Tpwm is larger than the phase difference T1 (Tpwm>T1).

Assuming that the size S is equal to 20 μm, the velocity V is equal to 112.5 mm/s, the phase difference is equal to 1 μs, the number n is equal to 70, and the light emission time Tpwm is equal to 100 μs, the product of the velocity V and the phase difference T1 is 0.1125 μm, which is sufficiently smaller than the size S of 20 μm. The product of the velocity V, the phase difference T1 and the number (n−1) is 7.7625 μm, which is smaller than the size S of 20 μm. The light emission time Tpwm is larger than the phase difference T1 (100 μs>1 μs).

Figure 19:
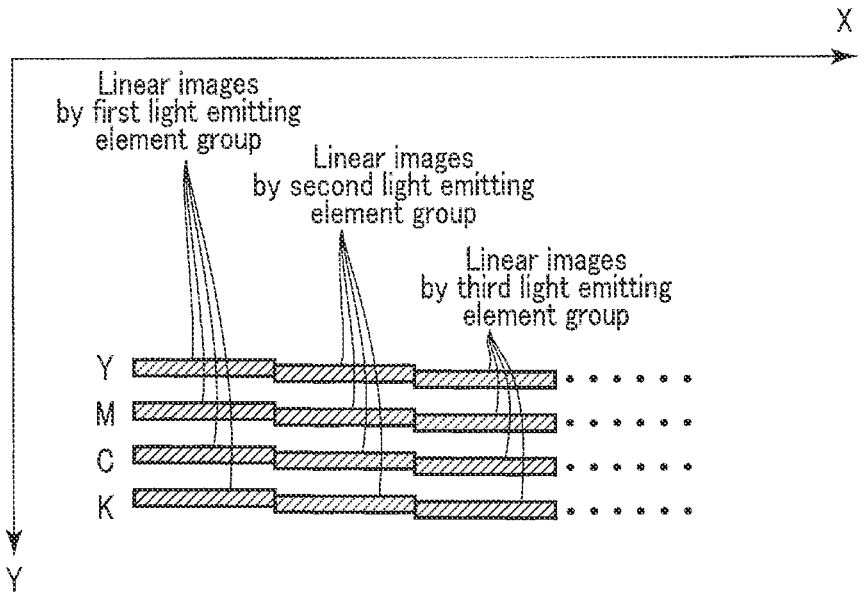
FIG. 19 is a diagram showing an example of an image formed by a plurality of print heads according to the embodiment.

FIG. 19 is a diagram showing an example of an image formed by a plurality of print heads according to the embodiment. The image shown in FIG. 19 is a color image formed by a plurality of print heads corresponding to yellow (Y), magenta (M), cyan (C) and black (K) colors.

The IC 15 outputs PWM signals having different phases, which are synchronized with a horizontal synchronization signal, to the light emitting element groups 160 of the print heads 1 such that the light emitting element groups 160 included in the print heads 1 emit light in the same light emission order and the light emitting element groups 160 included in the print heads 1 have the same phase difference T1. According to the present embodiment, a color image having excellent color overlay accuracy can be formed.

The foregoing embodiment can provide an image forming apparatus that is excellent in load reduction of a drive circuit of a print head. That is, the image forming apparatus outputs drive signals of different phases to each of the light emitting element groups to reduce a current flowing through the lines of the drive circuit of the print head and reduce the load of the drive circuit. The image forming apparatus can also reduce the step of an image by outputting a drive signal whose phase difference is smaller than the light emission time of each of the light emitting element groups. If, furthermore, the light emitting element groups with continuous light emitting elements are configured by continuous light emitting elements, a portion where a step occurs can be minimized. That is, the image forming apparatus can achieve both load reduction of the drive circuit of the print head and suppression of degradation of image quality.

The present embodiment can provide a print head and an image forming apparatus which are excellent in reducing the load of the drive circuit of the print head without degrading the quality of an image.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. A print head for an image forming apparatus, comprising:

one or more light emitting element arrays including a plurality of light emitting elements arrayed continuously along a main scanning direction;

a light emission control circuit configured to output drive signals of different phases for each light emitting element group including a predetermined number of continuous light emitting elements included in the light emitting elements; and one or more drive circuit arrays including a plurality of drive circuits configured to cause the light emitting elements to emit light individually based on the drive signals, wherein the image forming apparatus comprises a photoreceptor that moves in a sub-scanning direction and on which a latent image is exposed by light emission of the light emitting elements, and a relation S>V+T1 is satisfied, where T1 is a phase difference between drive signals of two adjacent light emitting element groups, S is a size of the light emitting elements in the sub-scanning direction, and V is a velocity of the photoreceptor in the sub-scanning direction.

2. The print head of claim 1, wherein a relation Thsyn>T1×(n−1) is satisfied, where Thsyn is a light emission cycle of the light emitting elements, and n is the number of light emitting element groups.

3. The print head of claim 2, wherein a relation Tpwm>T1 is satisfied, where Tpwm is a time width of the drive signals.

4. The print head of claim 1, wherein a relation Tpwm>T1 is satisfied, where Tpwm is a time width of the drive signals.

5. The print head of claim 1, wherein the light emitting element arrays include a first light emitting element array including odd-numbered light emitting elements and a second light emitting element array including even-numbered light emitting elements.

6. The print head of claim 5, wherein the light emitting elements included in the first light emitting element array and the light emitting elements included in the second light emitting element array are shifted in the main scanning direction.

7. The print head of claim 5, wherein the light emitting elements included in the first light emitting element array and the light emitting elements included in the second light emitting element array are shifted by pitch P in the main scanning direction, where a pitch between the odd-numbered light emitting elements is 2P, and a pitch between the even-numbered light emitting elements is 2P.

8. The print head of claim 7, wherein a size of the light emitting elements in the main scanning direction is equal to or larger than the pitch P.

9. The print head of claim 7, wherein the drive circuit arrays includes a first drive circuit array configured to cause the light emitting elements including the first light emitting element array to emit light individually based on the drive signals and a second drive circuit array configured to cause the light emitting elements including the second light emitting element array to emit light individually based on the drive signals.

10. The print head of claim 1, wherein a relation $S>V\times T1\times(n-1)$ is satisfied, where n is the number of light emitting element groups.

11. An image forming apparatus comprising:

one or more light emitting element arrays including a plurality of light emitting elements arrayed continuously along a main scanning direction;

a light emission control circuit configured to output drive signals of different phases for each light emitting element group including a predetermined number of continuous light emitting elements included in the light emitting elements;

one or more drive circuit arrays including a plurality of a drive circuits configured to cause the light emitting elements to emit light individually based on the drive signals; and a photoreceptor that moves in a sub-scanning direction and on which a latent image is exposed by light emission of the light emitting elements, wherein a relation $S>V\times T1$ is satisfied, where T1 is a phase difference between drive signals of two adjacent light emitting element groups, S is a size of the light emitting elements in the sub-scanning direction, and V is a velocity of the photoreceptor in the sub-scanning direction.

12. The image forming apparatus of claim 11, wherein a relation $Thsyn>T1\times(n-1)$ is satisfied, where Thsyn is a light emission cycle of the light emitting elements, and n is the number of light emitting element groups.

13. The image forming apparatus of claim 12, wherein a relation $Tpwm>T1$ is satisfied, where Tpwm is a time width of the drive signals.

14. The image forming apparatus of claim 11, wherein a relation $Tpwm>T1$ is satisfied, where Tpwm is a time width of the drive signals.

15. The image forming apparatus of claim 11, wherein the light emitting element arrays include a first light emitting element array including odd-numbered light emitting elements and a second light emitting element array including even-numbered light emitting elements.

16. The image forming apparatus of claim 15, wherein the light emitting elements included in the first light emitting element array and the light emitting elements included in the second light emitting element array are shifted in the main scanning direction.

17. The image forming apparatus of claim 15, wherein the light emitting elements included in the first light emitting element array and the light emitting elements included in the second light emitting element array are shifted by pitch P in the main scanning direction, where 2P is a pitch between the odd-numbered light emitting elements and between the even-numbered light emitting elements.

18. The image forming apparatus of claim 17, wherein a size of the light emitting elements in the main scanning direction is equal to or larger than the pitch P.

19. The image forming apparatus of claim 17, wherein the drive circuit arrays includes a first drive circuit array configured to cause the light emitting elements including the first light emitting element array to emit light individually based on the drive signals and a second drive circuit array configured to cause the light emitting elements including the second light emitting element array to emit light individually based on the drive signals.

20. The image forming apparatus of claim 11, wherein a relation $S>V\times T1\times(n-1)$ is satisfied, where n is the number of light emitting element groups.

* * * * *